United States Patent [19]

Kojima

[11] Patent Number: 4,662,119

[45] Date of Patent: May 5, 1987

[54] AUTOMATIC LENS GRINDING APPARATUS

[75] Inventor: Hideo Kojima, Ina, Japan

[73] Assignee: Haruchika Precision Company, Ltd., Ina, Japan

[21] Appl. No.: 679,401

[22] Filed: Dec. 7, 1984

[30] Foreign Application Priority Data

Jul. 25, 1984 [JP] Japan ..... 59-154731
Aug. 8, 1984 [JP] Japan ..... 59-164515

[51] Int. Cl.[4] ..... B24B 13/02
[52] U.S. Cl. ..... 51/55; 51/4; 51/235
[58] Field of Search ..... 51/55, 3, 5 R, 4, 284 R, 51/134 R, 215 E, 235; 269/21

[56] References Cited

U.S. PATENT DOCUMENTS

| | | | |
|---|---|---|---|
| 2,715,796 | 8/1955 | Beard | 51/3 |
| 3,555,737 | 1/1971 | Terakado et al. | 51/5 R |
| 3,913,271 | 10/1975 | Boettcher | 51/134 |
| 4,173,848 | 11/1979 | Ikeno | 51/55 |

FOREIGN PATENT DOCUMENTS

| | | | |
|---|---|---|---|
| 0093262 | 5/1984 | Japan | 51/284 R |

*Primary Examiner*—Frederick R. Schmidt
*Assistant Examiner*—Robert A. Rose
*Attorney, Agent, or Firm*—Murray Schaffer

[57] ABSTRACT

Lenses are successively and continuously fed to first precision grinding and cutting device wherein they are ground. Thereafter, the lenses are automatically conveyed to a second grinding and polishing device wherein they are further polished, and finally the lenses are automatically removed, washed and discharged from said apparatus.

10 Claims, 17 Drawing Figures

(c)

(a)

(b)

AUTOMATIC LENS GRINDING APPARATUS

FIELD OF THE INVENTION

This invention relates to apparatus for the precision grinding of spherically centered lenses of medium and small diameters and in particular to such apparatus in which the respective steps of feeding, grinding and removing lenses and conveying and positioning the lenses are fully integrated and automated.

BACKGROUND OF THE INVENTION

In general, the convention lens grinding apparatus can be largely divided into two kinds, depending on whether a holder shaft in the tip direction is always pressing the spherical center of a grinding dish or not. The present invention relates to the former apparatus wherein lenses are ground by being swung about the spherical center of the grinding dish as a grinding center. In this type of apparatus, there is a system wherein the grinding dish is swung and a system wherein the holder shaft on which the lens is mounted is swung. In the latter, the adjustment of the machine is so difficult that the swing angle will vary and due to the error the lens will be pressed in an unbalanced state resulting in low reproducibility of the lens radius R. In addition, as a result of this unbalance, the grinding dish will be worn unevenly and the grinding dish radius R and swinging state will have to be frequently readjusted. In the latter situation, concave lenses will present few problems, but with convex lenses many problems will arise. Also, in this method, as the holder shaft (upper shaft) is swung, the control in the structure will be complicated and the stability of the machine will be low.

Therefore, the method wherein the grinding dish is swung about the spherical center of the dish has come to be conventionally adopted. In this method, however, as the entire dish support is swung like a pendulum through the rotation of a cam or crank, usually by a motor or the like, the weight of the entire dish support, swung by the rotating angle of the cam or crank, will be added, the swinging speed will become unstable and the swinging frequency will be difficult to increase.

As a result, there will be produced the following defects:

(1) When the swinging direction rises, all the weight including that of the swinging base will be added, but on the contrary, when the swinging direction lowers, the dish support will be pushed in by the weight of the load and the swinging speed will become non-uniform.

(2) For the foregoing reason at the turning point of swinging, the cam and crank will be braked so suddenly that the grinding dish will be instantaneously swung in the reverse direction. At this time, a severe shock will be caused. In order to make the apparatus endure such shock, structural and economical problems must be overcome.

(3) In order to adjust the cam and crank, the fulcrum must be changed. In order to change the swinging angle and amplitude, they must be separately set. Further, as adjustments by hand and sense are required, there will be no reproducibility. Needless to say, fine adjustments are quite impossible.

Further, in the conventional lens grinding systems, as only one lens can be ground at any one time, the work efficiency is low and further, as the steps of conveying, feeding and removing the lenses are made by hand, it is impossible to grind many lenses at once.

It is the object of the present invention to solve such problems as are mentioned above by providing the following:

(1) An air cylinder or oil pressure cylinder is used for the swinging power so that within the swinging range, the swinging speed will be very natural as in a pendulum and, near the turning point of swinging, the air within the cylinder will acts as an air cushion to reduce the sudden shock of turning;

(2) All the so called grinding steps of feeding, grinding and removing the lenses are automated and these operations are continuous;

(3) The lenses are conveyed continuously between the respective operating steps;

(4) The mechanical adjustment, so far made only by the human sense, can be made numerically, so that errors will be few and the finished lenses will be of a good and high quality;

(5) The operations of conveying the lenses to the lens grinding tank and positioning the lenses are made by an air cylinder;

(6) The grinding apparatus is provided with a lens conveying and positioning device wherein four basic shafts are rotated at a pitch of $\frac{1}{4}$ rotation and a lens conveying and positioning device wherein two horizontal basic shafts are operated simultaneously;

(7) Further, the entire apparatus itself is unified and compacted.

SUMMARY OF THE INVENTION

The present invention is developed as mentioned above as an automatic lens grinding apparatus comprising a lens feeding device wherein work receptacles each containing a lens to be ground are conveyed through a belt conveyor in turn to a precision grinding and cutting machine, wherein the lens in the respective work receptacles are indexed into and positioned in respective grinding tanks and pellet-processing, thickness measuring, radius R comparing and measuring, resin-processing and discharging stations in one cycle, and a lens grinding machine wherein the lenses are conveyed into and positioned in respective grinding tanks and are ground by feeding, grinding and discharging steps and a lens removing device wherein the ground lenses are washed in a water tank.

The effects of the apparatus of the present invention are as follows:

(a) The lens grinding apparatus which so far has been impossible to unify is now integrated and the lens can be finished uniformly and highly precise by automation.

(b) The apparatus itself is simple to adjust and mechanical adjustment being so far dependent on human sense, is now numerically or computer controlled, therefore, the operator does not require any high technique competence. The operation is easy and a high reproducibility and stability can be maintained over a long period.

(c) This apparatus can be set-up within a short time. Therefore, many kinds of small lot lines can be introduced, and automated lines in a wide range can be set. The range of application is wide and the practicality of the machine is high.

(d) In the present apparatus, the arm of a conveying robot performs the role of the upper lens loading shaft of the machine, and a robot or the like for indexing lenses is not required, and therefore, the working rate can be very high.

(e) The structure is high in stability and the adjustment can be made at a high precision. Therefore, as is mentioned above, high quality lenses can be finished at a high working rate.

(f) As the upper lens loading shaft of the machine moves vertically, the thickness of the lens being ground can be simply measured while being automatically adjusted.

(g) Further, the structure is simple and can be made small and, therefore, the equipment is easy to control and is high in safety and economy.

DETAILED EXPLANATION OF THE INVENTION

Figure 1:
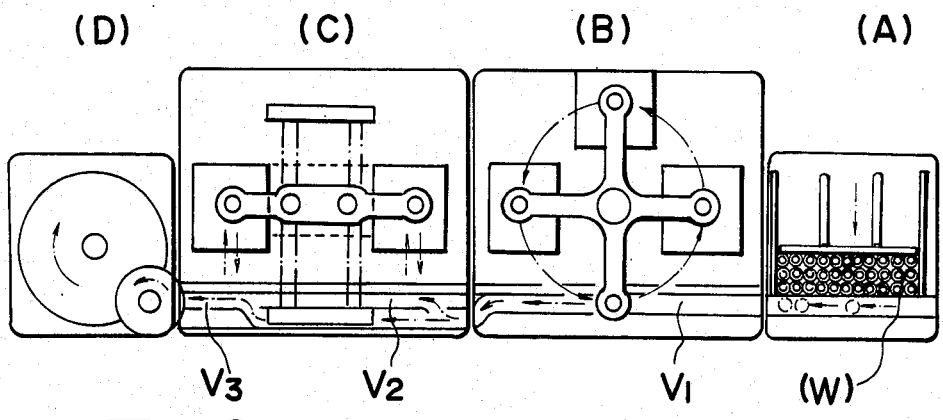
FIG. 1 is a schematic view of the entire system of the present invention.

An overall view of the present invention is seen in FIG. 1. Basically the system comprises a lens source and feeding mechanism A; a precision grinding and cutting mechanism B; a lens polishing mechanism C and a lens washing and removing mechanism D. The feed mechanism A comprises a conveyor such as a belt conveyor for successively feeding work receptacles W each containing a lens to the precision grinding and cutting mechanism B. The precision grinding and cutting mechanism B comprises a vertically movable and rotatable support indexable through four basic work stations wherein the lenses sequential cycle through the steps of pellet-processing (thickness-measuring), radius comparing and measuring, resin-processing and finally discharging to the polishing mechanism C. The lens polishing mechanism C is a device for vertically moving and rotating the two basic shafts by which the earlier precisely ground lenses are reground in the simultaneous steps of feeding, grinding and discharging the lenses. The removing part D is a device for spray-washing the lenses after being completely ground. By the way, the lens conveying belt conveyors V1, V2 and V3 are made to be continuously and automatically controlled. The grinding methods and devices of the precisely grinding and cutting mechanism body B and the grinding mechanism body C are respectively identical.

Figure 2:
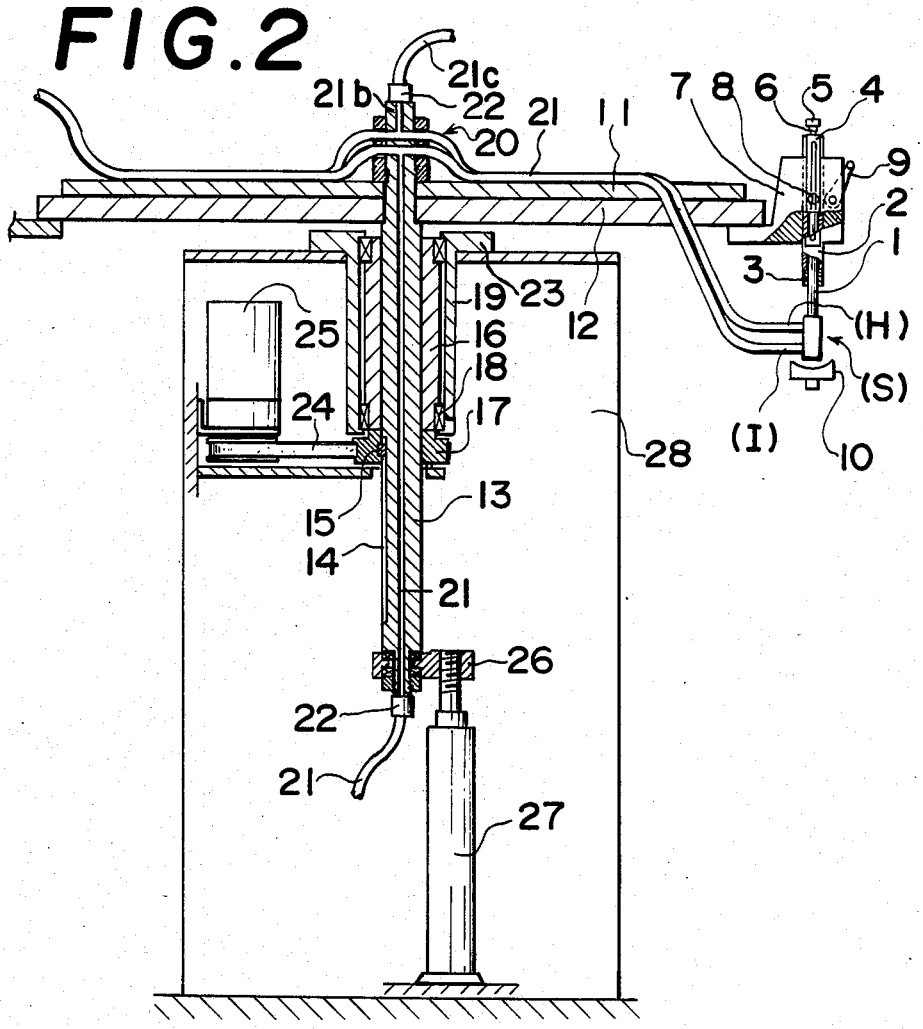
FIGS. 2 is a partly sectioned view of the four station indexing and lens loading device for the precision grinding and cutting apparatus.
Figure 3:
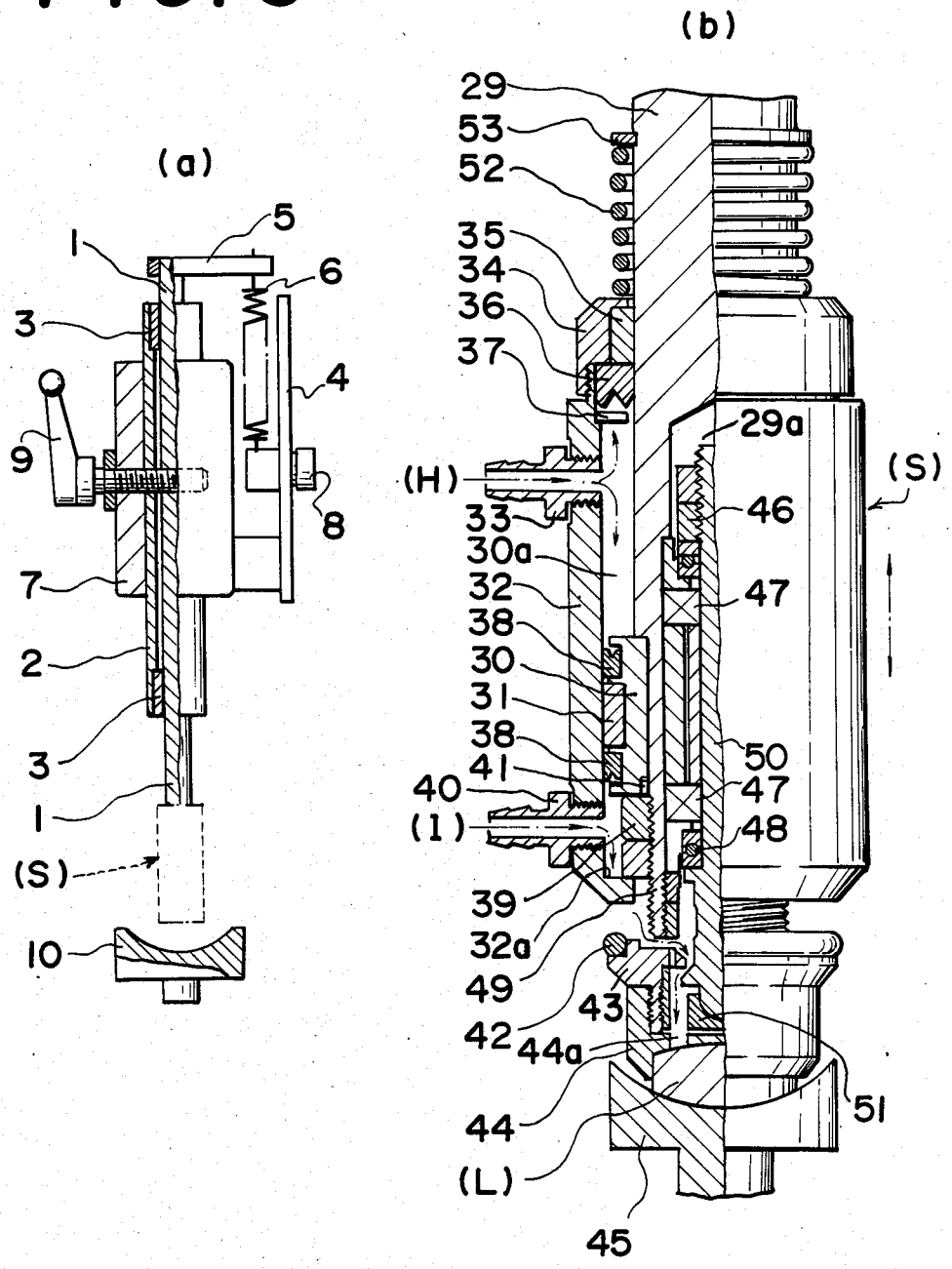
FIG. 3*a* is an enlarged view of the lens holding shaft, used in the apparatus of FIG. 2.
FIG. 3*b* is an enlarged view of the lens loading device shown in FIG. 3*a;*

FIGS. 2 and 3 show the precision lens grinding and cutting mechanism B. In this grinding and cutting mechanism B four lens conveying and positioning devices S are arranged on each of the arms of a cross, so as to be rotated at a pitch of 90 degrees on the periphery to move in turn to each of the lens processing stations fitted in three places. The structure and operation of the precision grinding and cutting machine shall be explained in the following:

A holder shaft 1, fitted at the lower tip with a lens positioning device S, is inserted in a holder sleeve 2 through metallic bearing seals 3 and is held at the upper end by a shaft pressing nut 5 which is resiliently fitted through a spring 6 to a wing bolt 8 fitted to a spring base 4. The holder sleeve 2 passes through an arm 7 which is adjustable relative to the sleeve 2 by a crank lever 9, so that the positioning device S at the end of the holder shaft 1 can be placed in opposition to the work performing station such as a grinding dish 10. The arm 7 is secured at the end of a loading arm 12 which is fixed to a loading table 11. The loading arm 12 and table 11 are mounted at the upper end of a vertical shaft 13 by a nut 19. The shaft 13 is formed with a longitudinal keyway 14 and key 15, over which is fitted an elongated sleeve 16 having integrally formed at its lower end a timing pulley 17. The sleeve 16 is journaled by bearings 18 surrounded by an outer fixed sleeve 23 having a radially extending collar 23*a* fixed to a supporting frame 28. The pulley 17 is driven via belt 24 by a rotatable motor 25. The lower end of the shaft 13 is rotatably keyed to a cylindrical knuckle 26 which is threadedly secured to the rod of an air piston/cylinder 27. In this way the shaft 13 and the cruxiform arms 12 carried by it is rotatable about the central axis of the shaft 13, by motor 25 while being simultaneously vertically reciprocable by actuation of the air cylinder 27.

A vacuum distributor manifold 20 is located at the upper end of the shaft 13, which is also formed with a central hole 21 connected at its lower end by a rotating air joint 22 and hose 21*a* to a vacuum generator. The manifold 20 is also provided with an air inlet 21*b* and hose 21*c* open to atmosphere. The vacuum and atmosphere ducts 21 and 21*a* are connected respectively to the lens conveying and positioning device S.

The details of the lens conveying and positioning device S will now be explained with reference to FIG. 3(*b*). The device comprises a holder shaft 29 (see shaft 1, FIG. 2) which has a central bore 29*a* extending forward from its lower end. The lower end is threaded and has secured thereto a head 43 to which is attached a chuck 44 in which the lens L is held. The outer surface of the lower end of the shaft 29 is of reduced diameter and has set thereon a piston 30 fixed at its upper end by the shoulder of the reduced section and at its lower end by packing 38 and locking nut 39 threaded to the shaft 29. A sleeve 32 surrounds the piston 30 and defines with the shaft 29 a chamber 30*a*. The upper end of the sleeve 32 is closed by a removable cap 34 and is slidably sealed with respect to the shaft 29 by a bearing sleeve 35, packing 36 and a locking piece 37. At its lower end the sleeve 32 is provided with a radially inwardly directed flange 32*a*. Slidably sealing the piston 30 relative to the sleeve 32 is a metal bearing sleeve 31 and packings 38. Sealing the piston 30 relative to the shaft 29 is an O-ring 41. An O-ring 42 is mounted on the head 43 and is adapted to seat against the inward flange 32*a* when the shaft 29 is raised relative to the sleeve 32. Mounted within the interior chamber 29*a* of the shaft 29 is a center lock nut 46 in which is positioned a centering spindle 50, journaled in a radial bearing 47 and thrust bearing 48. The lower end of the spindle 50 is held by a second centering nut 49. The spindle is provided with a tapered point 51 pressing against the chuck 44. The grinding dish 45 (see disc 10, FIG. 2) is located beneath the lens L held in the chuck. The outer sleeve 32 is biased by a compression spring 52 abutting a stop washer 53. The sleeve is provided with an inlet port 33 for high pressure air and an inlet 40 for vacuum, both communicating with the chamber 30*a*.

The lens positioning device S operates as follows.

Basically, when the lens L is to be ground it is received in the holding chuck 44 and air under pressure fed via inlet 33 to the chamber 30*a* causing the downward movement of the holder shaft 29 which causes the spindle 51 to press against the chuck 44, moving the lens into contact with the dish 45. The lens is ground by the rotation and swinging movement of the grinding dish 45 in a manner to be explained. When the lens L is ground and is to be conveyed to another station, or for example, to be removed, pressurized air through the inlet 33 is stopped and the sleeve 32 descends causing the O-ring seal 49 to abut against the lower end of the outer sleeve 32 and a vacuum is applied to the chamber 30*a* via port 40 which is now open to chamber 44*a* in the chuck 44. The lens will be sucked into the chuck 44. Thus, the lens L to be ground and conveyed will be secure and can be conveyed between stations and will be able to be accurately and positively positioned. More particularly, in the case of grinding the lens L, compressed air H is made to flow into the chamber 30*a* and the sleeve 32 is moved upward due to the increased pressure on the opposed slide bearings 31 and 35. The lower flange 32*a* of the sleeve 32 will thus separate from the holder head 43 of the chuck 44 and will be raised until it contacts the piston locking nut 39 (as seen in FIG. 3*b*). This opens the chuck chamber 44*a* to atmosphere. Then the grinding dish 45 will be activated to swing while rotating to grind the lens L. In the case of conveying the lens after it is ground, the compressed air within the chamber 30*a* is discharged through the port 33 to atmosphere, the sleeve 32 will be pressed downward through the action of the compression spring 52. This downward movement of the sleeve 32 causes the flange 32*a* to separate from the piston locking nut 39 and abut against the O-ring seal 42. Air is then withdrawn through the port 40 so as to place the chuck chamber 44*a* under a state of vacuum, sucking the lens L from the grinding dish 45 into the chuck 44.

Figure 4:
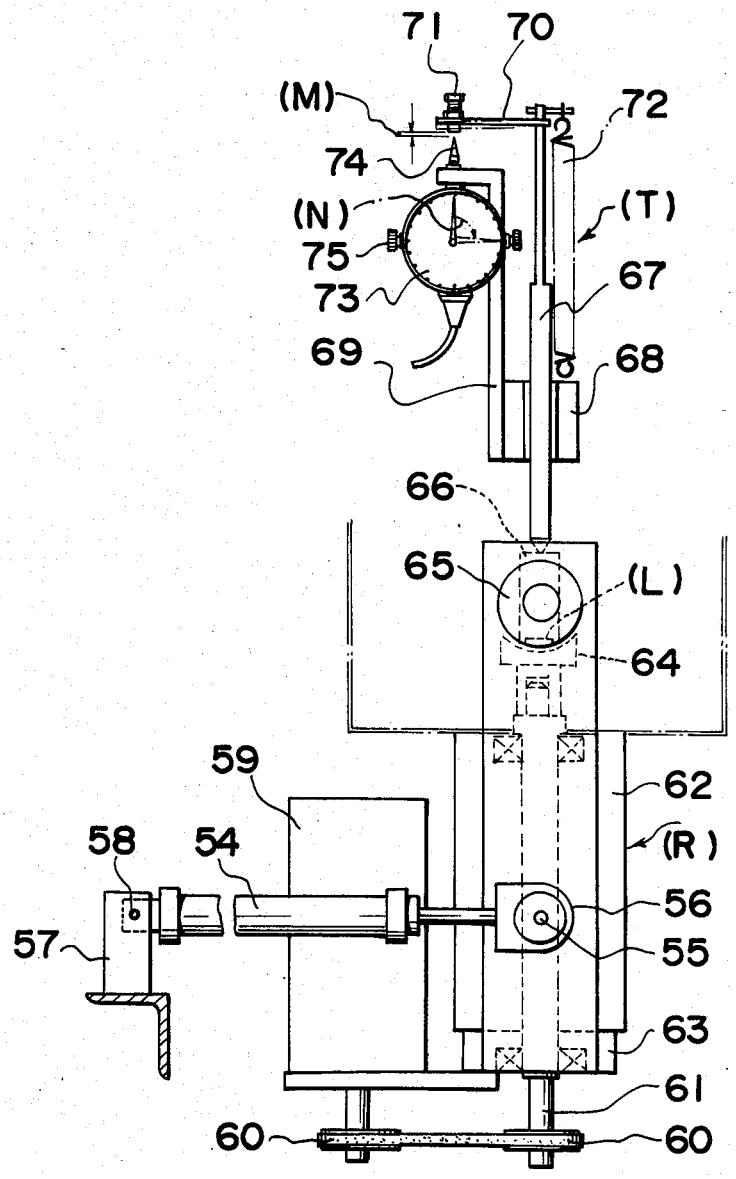
FIGS. 4 and 5 are respectively an elevation and grinding state view of a device which is an essential part of the lens grinding machine body.
Figure 5:
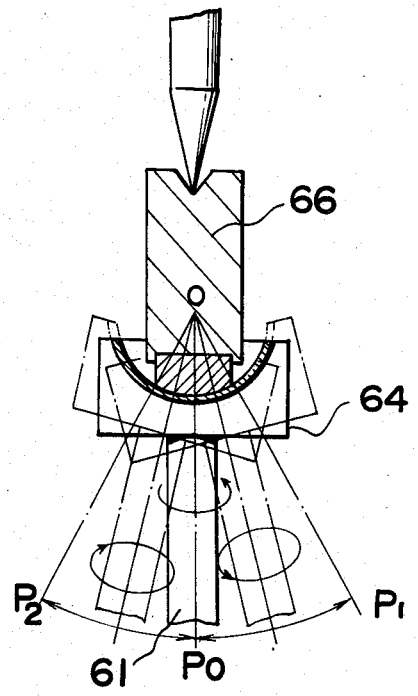

Details of the device for rotating and swinging the grinding dish 45 and for pressing the lens holder S against the grinding dish 45 are shown in FIGS. 4 and 5. The grinding dish swinging and rotating device is shown generally by the letter (R) in FIG. 4 and comprises a swinging fluid cylinder 54 from which a piston rod 55 extends and is connected by a bearing 56 to a spindle 61. The rear end of the cylinder 54 is pivotally secured on a footing 57 by a linch pin 58. A rotating motor 59 is fixedly mounted so as to be operatively connected to the spindle 61 through a pair of spaced V-belt timing pulleys 60. The grinding dish 64 (equivalent to the earlier reference to dish 54) is mounted at the upper end of the spindle 61 and the unit is enclosed in a sleeve 62 having a base 63. When the motor 59 is rotated, the spindle 61 will be rotated rotating in turn the grinding dish 64. Held in a bearing 65 is a covering and pressing device 66 (such as S in FIG. 3*b*) by which the lens L is held and pressed against the grinding dish 64.

The device by which the grinding of the lens is measured is denoted by the letter (T). Acting on the device 66 is the holder shaft 67 (e.g. shaft 1 in FIG. 3*a*), which is reciprocable in a sleeve 68 secured to a support plate 69. A detecting plate 70 is mounted to the upper end of the shaft 67 to extend perpendicularly therefrom. At the free end of the plate 70 is mounted an adjustable bolt 71. The plate 70 is biased by a spring 72 attached between its rear end and the sleeve 68. Mounted on the support plate 69 below the adjustable bolt 71 is a dial gauge 73, having a contact 74. The gauge is selectively set by knobs 75 to a given degree of grinding desired, and forms a variable contact for an electrical current for controlling operation of the cylinder 54 and motor 59. The degree to which the lens is to be ground is determined, as soon as the grinding dish 64 is put into place and is rotated, and the entire box swung by action of cylinder 54 and motor 59. As the covering and pressing device 66 is pressed through the holder shaft 67, the lens L located against the grinding dish 64 will be automatically ground. In such case the shaft 67 descends carrying with it the adjustable bolt 71. When the grinding proceeds to the graduation of the dial gauge 73 at which the measured value is set, and the bolt 71 causes the contact 74 to push the needle N to the graduation of the measured value, the grinding dish 64 will automatically stop. That is to say, if the lens L is ground by the distance M, the adjusting bolt 71 will move by M downward and will press the measuring terminal 74 by the distance M and, therefore, the lens will be ground by the measured value of M.

FIG. 5 shows the principles by which the grinding dish 64 is swung and rotated. First of all, it is to be recalled that the grinding dish 64 is swung by activation of the cylinder 54 (FIG. 4) which is connected to the housing 62 in which the spindle 61 is journaled. As seen in the drawing, the swing of the grinding dish 64, is made about a center O lying above the lens being the spherical center of the dish. If the grinding dish 64 is swung with the center line PO through the weight balance of the swinging base inclined by about 15 to 20 degrees, and the swinging state is upward (to position P1), the swinging base will always be able to be lifted with the same force irrespective of the extending stroke of the rod of the cylinder 54. On the other hand, when the swinging state is downward (toward position P2), the discharging speed of the cylinder will be able to be freely adjusted so that the rod can come to any desired position. Incidentally, in the event an air cylinder is used, near the swing turning point PO (0 degrees) the air cylinder will be able to be swung in a very natural state like a pendulum to reduce the shock. The swinging angle and its amplitude will be able to be adjusted freely by manual operation from outside without putting a hand into the machine.

Figure 6:
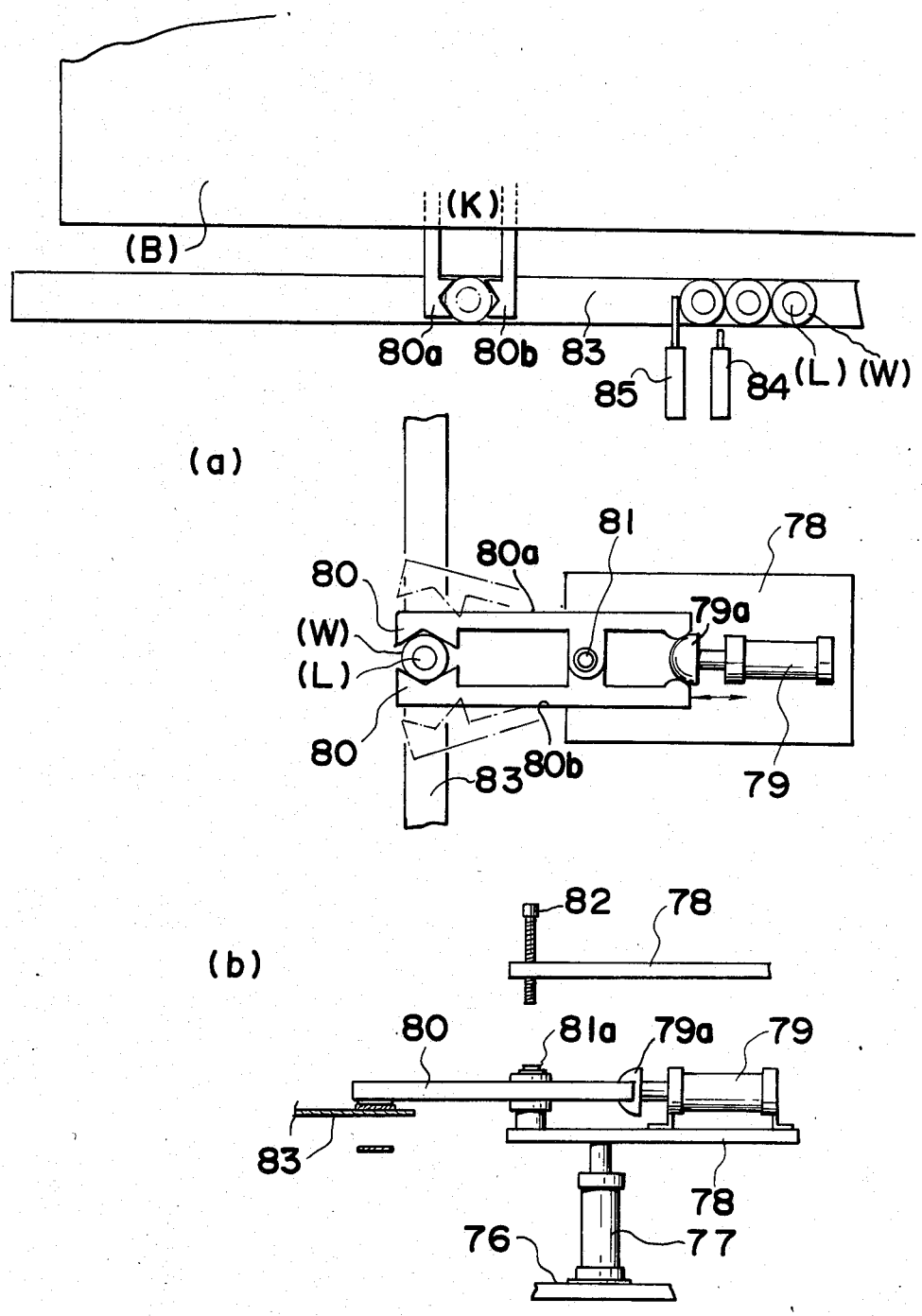
FIG. 6*a* is a side elevational view of devices shown in FIGS. 6*a* and 6*b;*
FIG. 6*b* is an enlarged plan view of the transfer device.
FIG. 6*c* is a plan view of the conveying and transferring device for the lens receptacles.

In FIG. 6*b* the method and apparatus for transferring the lenses to and from the precision grinding and cutting machine B is shown. Mounted on a horizontal base 76 is a vertical disposed cylinder 77 on which a horizontal platform 78 is mounted. Mounted on the platform 78 is a horizontally disposed air cylinder 79 which when activated moves reciprocally in the direction of the arrows, opening and closing a scissor type caliper loading tong 80. The loading tong 80, as seen in FIGS. 6*a* and 6*c*, comprises a pair of arms 80*a* and 80*b* pivoted together about a pin 81. The rear ends of the arms 80*a* and 80*b* engage with the tip part of the cylinder rod 79*a* and is further fixed to the base 78 through a boss 81*a*. An adjusting bolt 82 for adjusting the level of the loading tong 80 is provided. The transfer assembly is arranged (FIG. 6*c*) so that the tong 80 is perpendicular to and directly above the upper run of a continuous belt conveyor 83 by which the work receptacles W with lenses L are removed from the source or feed device A shown in FIG. 1. Cylinders 84 and 85 operable in alternating sequence separate and section the work receptacles W one by one so that they may be grasped and transferred individually by the tongs 80.

Figure 10:
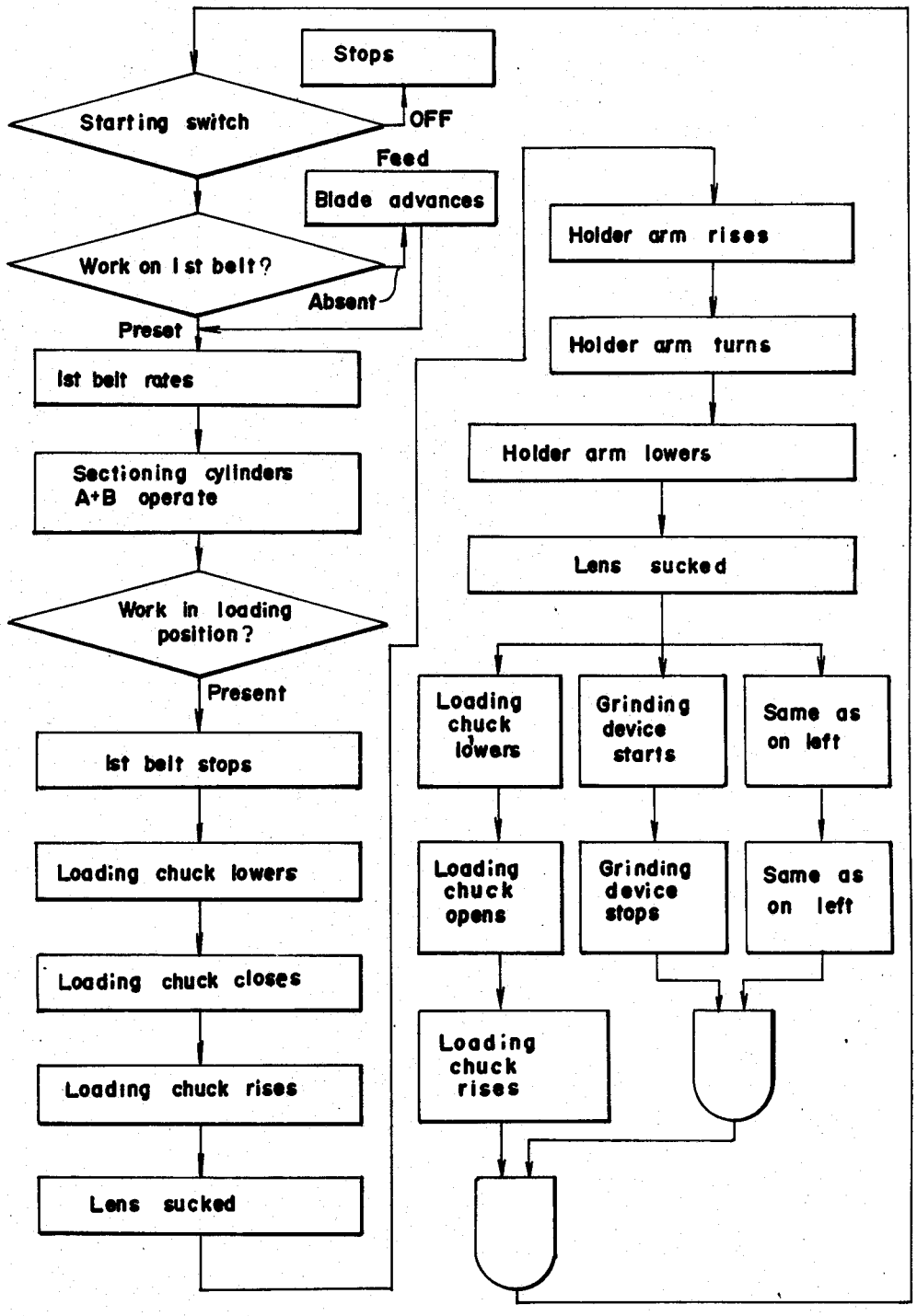
FIG. 10*a* is a flow chart of the operation of the present apparatus.
FIG. 10*b* is a continuation of the flow chart.
Figure 10:
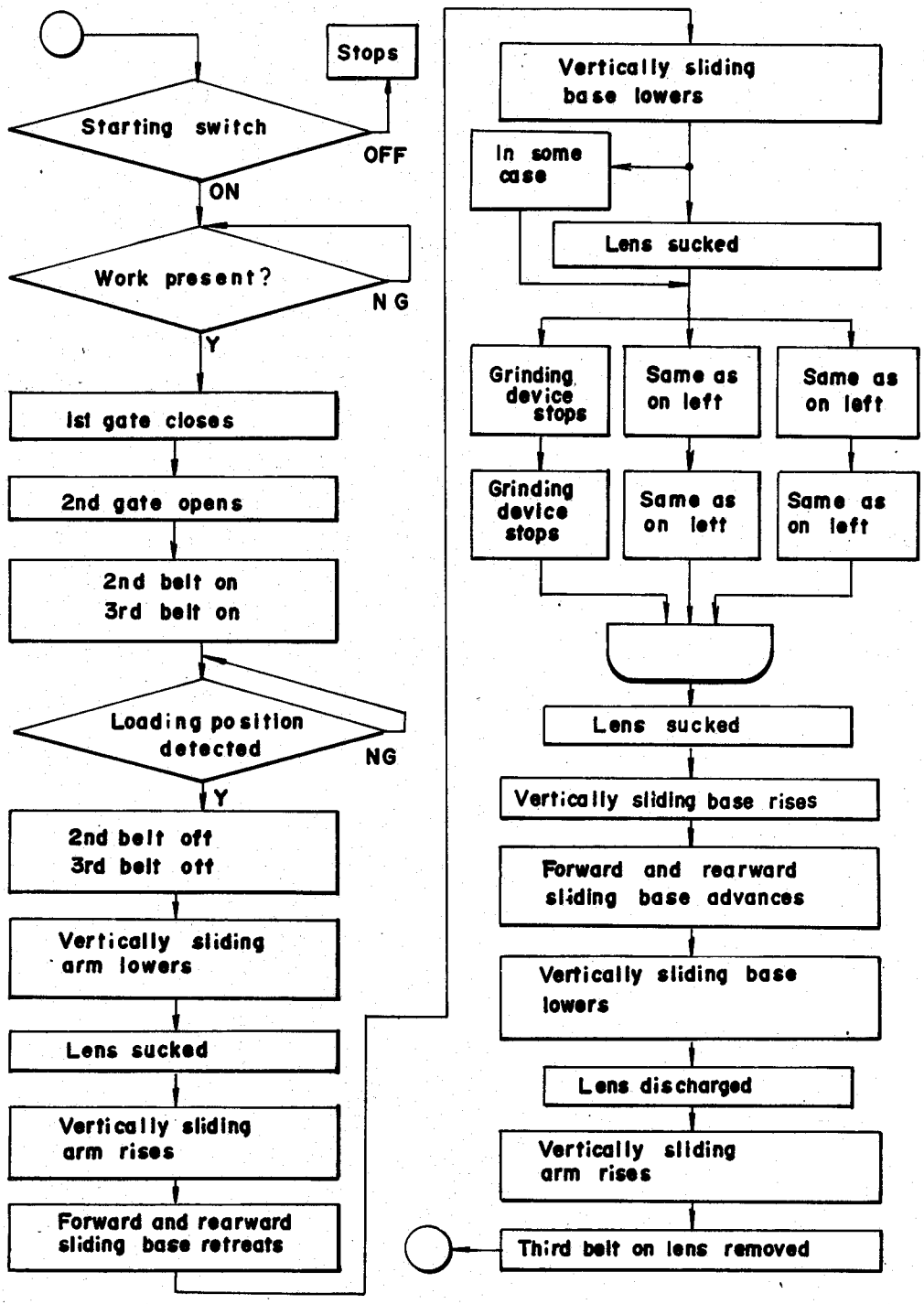

The operation together with the flow chart in FIG. 10(*a*) shall be explained in the following. First of all, the starting switch of the precision grinding and cutting machine B is switched on and the first conveyor belt 83 is rotated to convey the work receptacles W fed from the lens feeding part A in turn to the loading position K. In such case, the respective cylinders 84 and 85 will be alternately operated to feed the work receptacles W one by one to the loading position K. That is to say, by the alternate operation (when one extends, the other will retract) of the cylinders 84 and 85, the work receptacles W will be fed one by one while the remaining ones are retarded on the belt 83. When a work receptacle W comes to the loading position K, the first belt 83 will stop for a while, and the cylinders 77 and 79 (for raising and lowering the platform 78 and for opening and closing the chuck will be operated to move the loading tong 80 to the loading position K where it grasps the work receptacle W and conveys it toward the precision grinding and cutting machine B. By the way, in removing the ground lens from the precision grinding and cutting machine, the structure and operation reverse to this may be used.

Figure 7:
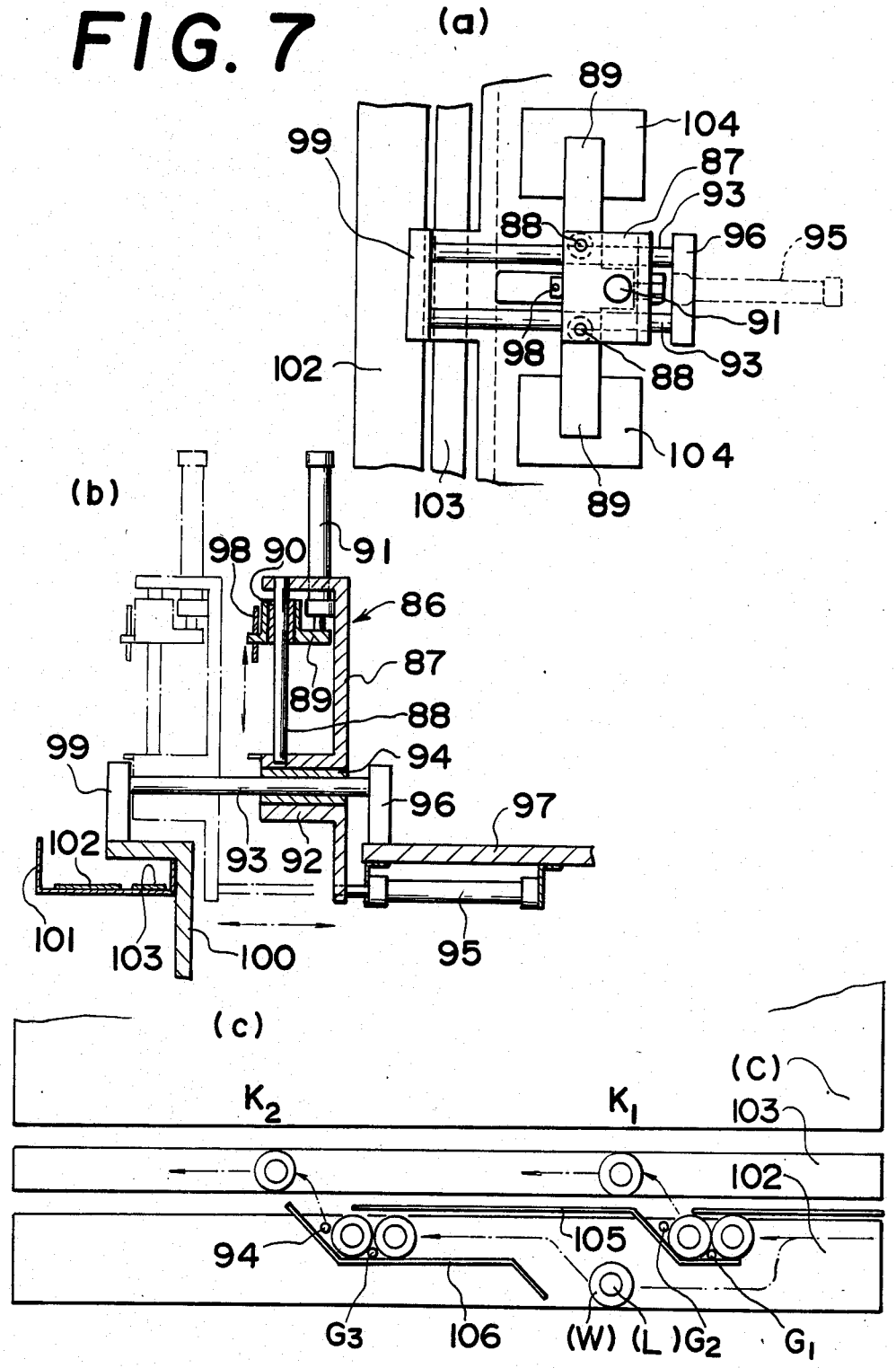
FIG. 7*a* is a plan view of the lens polishing mechanism.
FIG. 7*b* is an end elevational view of the mechanism of FIG. 7*a;*
FIG. 7*c* is an enlarged plan view of the conveyor for the mechanics of FIGS. 7*a* and 7*b;*

FIG. 7 shows the details of the second lens grinding or polishing mechanism C of FIG. 1. The lens transfer and holding device, generally depicted by the numeral 86, comprises a generally U-shaped supporting bracket 87 in which a pair of spaced vertical sliding shafts 88 are mounted. Slidably mounted for up and down movement on the shafts 88 are a pair of horizontally disposed arms 89 extending generally parallel to the conveyor for the work receptacles W, as seen in FIG. 1. Mounted at the end of each of the arms 89 is a lens holding and positioning device S as seen in FIG. 3 which carry the lens to an aligned tank 104 in which they can be washed and polished. The arms 89 are joined by a pair of hubs 90 slidable along the shafts 88 and an air cylinder 91 mounted on the bracket 87 is provided for vertically moving the sliding arms 89 along the sliding shaft 88. The hubs 90 are provided with an adjustable length bolt 98 for setting the extent of the vertical stroke of the arms 89. Further, the supporting bracket 87 is provided with a hub 92 in which is fit a bearing sleeve 94 through which a sliding shaft 93 fixed to a vertical support 96 at its rear and a similar support 99 at its front passes. An air cylinder 95 is mounted below the shaft 93 on a frame member 97, and a rod is fixedly connected to the bracket 87 so that it can move the entire bracket in the horizontal direction toward and rearwardly perpendicular to the feed belts.

Since an accumulation of lenses occurs following the first grinding operation in the mechanism B (FIG. 1), provision is made in this second grinding and polishing mechanism (C FIG. 1) to feed lenses to both holders S on the arms 89 respectively, so as to speed up the process. Thus, mounted to the frame part 100 on which the vertical support post 98 is already mounted, is a trough 101 in which the upper runs of a pair of conveyor belts 102 and 103 travel. Belt 102 is a continuation of the main conveyor belt 83 to which the first ground lenses are redeposited, while 103 is an auxiliary belt to which lenses are fed from belt 102. Located to the rear of the trough 101 in line with each of the arms 89 respectively is the grinding and polishing tank 104. Thus, the transfer apparatus 86 will move forward and rearward along the horizontal sliding shaft 93 due to the extension and contraction of the air cylinder 95, while the horizontal arms 89 provided with the lens grinding holder S will move vertically along the sliding shaft 88 through actuation of the air cylinder 91. By such vertical movement and forward and rearward movement, the lenses L fed from the respective belts 102 and 103 can be automatically and continuously sucked, transferred to tank 104 ground and then discharged from the second lens grinding mechanism.

Now, the operation shall be explained with reference to the flow chart of FIG. 10(*b*). First of all, when the work receptacles W are fed in turn onto the first belt 102, the work receptacles W will be arranged in turn in a line through the work guide 105 from which, by operation of the first gate G1 and second gate G2, they will be moved to the second belt 103 from which the lenses L will be able to be fed into the loading position K1 of the second conveyor 103 for attachment to the holder S at the end of one arm 89. On the other hand, when the work receptacles W to be fed to the first belt 102 can no longer be arranged at the work guide 105, they will be moved as seen by the arrows around the guide 105 and will be arranged in turn at a second work guide 106. There, the same transfer to belt 103 as is mentioned above, by the operation of the firt gate G3 and second gate G4 occurs and the lenses will be able to be fed to the second arm 81 at the loading position K2. In the loading positions K1 and K2, due to the vertical operation of the arm 89, the lens grinding holder S fitted to the transfer device 86 will advance and lower, will suck the lens L from the work receptacle W, will again rise and retreat, will be moved to the position of the grinding dish fitted to the grinding tank 104, and there the lens L will be automatically ground. After being completely ground, the lens L will be discharged into the work receptacle and will be removed together with the work receptacle W by the belt 103 in a reverse manner to that just described.

Figure 8:
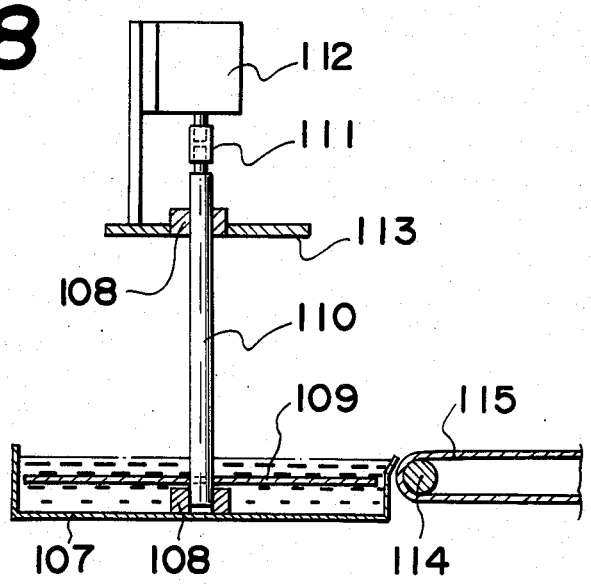
FIG. 8 is an elevation of a lens removing and washing device.

FIG. 8 shows the device for removing the lens from the apparatus. This lens removing device is a part of the apparatus for washing the lenses L with a spray after they are ground and comprises a water tank 107 in which a bearing 108 is secured to journal a vertical shaft 110 fitted with a horizontal turntable 109. The upper end of the vertical shaft 110 is journaled in a second bearing 108 located in a frame. The shaft 110 is connected to a rotary motor 112 by a coupling 111. The lens are conveyed to the tank through a third belt 115 entrained over one or more rollers 114 and will be deposited onto the constantly slowly rotating turntable 112 to be washed in the water within the tank 107. This lens device may also be used for conveying and feeding the work receptacles W to the precision grinding and cutting machine body B by reversing the operation so that the work receptacles W containing the lenses L may be arranged on the turntable, may be moved outwardly onto the feeding belt line by line and may be conveyed in turn to the grinding and cutting machine mechanism B.

Figure 9:
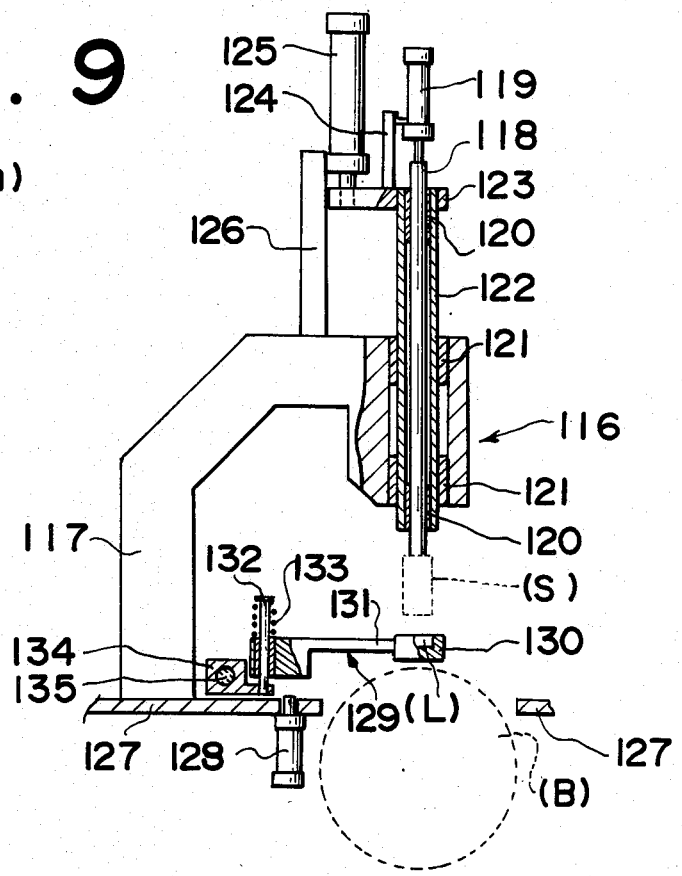
FIG. 9*a* is a side elevational view of another embodiment of the lens loading device.
FIG. 9*b* is an end elevational view of a series of devices shown in FIG. 9*a;*
Figure 9:
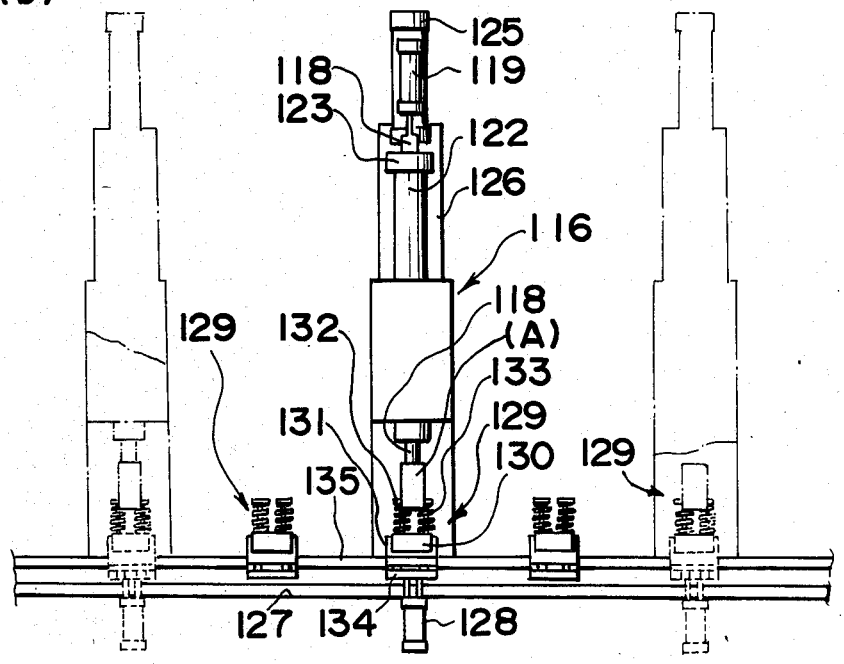

FIG. 9 shows another embodiment of a lens conveying device generally depicted by 116 comprising a supporting arm 117 set between the lens supply position A and the precision grinding and cutting device B (FIG. 1). The supporting arm 111 is mounted on a base 127 and is provided with a vertical shaft 118, reciprocable by a compressed air cylinder 119 acting on its upper end through a sleeve 122 provided internally with low friction metal bearing 120. The cylindrical supporting sleeve 122 is journaled within the arm 116 by metal bearings 121 and is connected at its upper end by a horizontal plate 123 connected to the piston rod of an air cylinder 125. The cylinders 119 and 125 are mounted on posts 124 and 126 respectively. The air cylinder 125 is adapted to slide and move the plate 123 and consequently the sleeve 120 vertically while the air cylinder 19 is adapted to vertically move the shaft 118. Mounted at the lower end of shaft 118 is a lens holding device S (FIG. 3). The base 117 is mounted on a machine frame part 127 to the lower surface of which an air cylinder 128 is also mounted. A lens loader assembly 129 is mounted on the upper surface of the frame part 127. The loader assembly 129 comprises an elongated arm 131 having a lens retaining receptacle 130 at its forward end and being slidably mounted at the rear end over a vertical shaft 132. The arm 131 is freely movable on the shaft 132, but is downwardly biased by a compression spring 133 acting on its upper surface. The shaft 132 is fixedly mounted to a support block 134 which is itself fixedly mounted on a horizontally reciprocable shaft 135 so that the moving shaft 135 may be reciprocated linearly rightward and leftward perpendicular to the vertical shaft 118 carrying with it the loader assembly 129. By this continuous movement of the loader assembly body 129, the lens L within the lens receptacle 133 can be conveyed in turn from the supply feed to the lens holder S.

In practical operation, as seen in FIG. 9*b*, a series of lens conveying devices 116 are arranged in a horizontal line alternating with a series of loading assemblies 129. Lens L are located in the lens receptacle 130 and are fed to the loader assembly 129. Then the moving shaft 135 is operated to move the loader assembly 129 leftward one by one. The loader assemblies are stopped (i.e. indexed) for a while in the position in which the conveying device 116 is set and the sliding shaft 132 is pushed upward by the air cylinder 128 to raise the lens receptacle 130 toward the lens receiving chuck contained in the holder S whereby the lens is sucked into the chuck. At the same time, the air cylinder 125 is operated to raise the plate 123 and the holder shaft 118. When the lens L is thus raised, the moving shaft 135 will again be moved leftward leaving the conveyor device 116 free to present the lens L to the grinding and cutting device. In such case, the lens L will be able to be ground irrespective of the movement of the loader assembly 129. When this operation is repeated in turn, the lens L will be continuously conveyed onto the grinding dish and will be able to be ground, so that when the holder bases 116 are arranged horizontally, the lenses will be able to be simultaneously ground by the same operation at the same time. Further, when the moving shafts 135 are set in several lines and are repeatedly moved in turn rightward and leftward, continuous operation will be possible.

I claim:

1. Apparatus for automatically processing lenses comprising a plurality of relatively spaced work stations at least one of which has a plurality of discrete machines for performing successive work operations on said lenses, a first conveyor for progressively transporting lenses from one station to another, and carrier means at least at said one station adapted to receive one of said lenses from said conveyor and sequentially indexing said one lens to and holding said one lens at each of said discrete machines during the work operation thereon, said carrier comprising:

a vertical shaft mounted for movement between said discrete machines;

a chuck mounted at the end of said shaft adapted to hold a lens;

an axially movable sleeve surrounding said shaft and forming an annular chamber therebetween;

a wall fixed to the outer surface of said shaft and slidably contacting the surface of said sleeve to divide said chamber into upper and lower sections;

spring means resiliently biasing said sleeve downwardly toward the lower end of said shaft;

and means effective in the downwardly biased position of said sleeve to seal the lower section of said annular chamber;

a duct passing through said chuck communicating at one end with said lens and at its other end with the lower section of said normally downwardly biased annular chamber;

means for applying a vacuum to the lower section of said annular chamber to cause said lens to be firmly held to said chuck; and means for applying fluid under pressure to the upper section of said sleeve to thereby cause said sleeve to be raised against the bias of said spring to free said lens from said chuck.

2. The apparatus according to claim 1, wherein said means for sealing the lower section of said annular chamber comprises the abutment of the lower end of the sleeve and the chuck.

3. The apparatus according to claim 2, including an O-ring seal mounted on said chuck adapted to engage the lower end of said sleeve.

4. The apparatus according to claim 1, wherein said work performing machines includes an oscillating and rotatable dish in which said work on said lens is performed and said shaft is provided with means for moving said chuck into and out of engagement with said dish.

5. The apparatus according to claim 4, wherein the plural work performing machines at said at least one work station are circumferentially spaced uniformly from each other, and a plurality of lens carriers are provided corresponding to the number of work performing machines, said lens carriers being disposed on a central support, said support being mounted for rotation about its central axis and for axial movement along said central axis, whereby said lens carriers are indexed progressively from one work performing machine to another and being raised and lowered relative to said respective work performing machines.

6. An automatic lens grinding apparatus according to claim 5, wherein said support is provided with four lens carriers and in the form of a cross and said carrier rotates at a pitch of $\frac{1}{4}$ rotation, said work performing station being arranged in three corresponding positions around said support.

7. The apparatus according to claim 5, wherein said means for raising and lowering said support comprises a fluid piston/cylinder actuator.

8. The apparatus according to claim 1, wherein said work stations comprise a first lapping device for grinding said lenses therein, a second lapping device for polishing said lenses therein and a discharge device for washing said lenses and discharging said lenses from said apparatus.

9. The apparatus according to claim 7, wherein said lenses are successively conveyed by a series of belt conveyors arranged to deliver and transfer said work receptacles and lenses to and from said first and second grinding devices and said washing and discharging devices.

10. The apparatus according to claim 5, wherein said shaft is provided with a lens position determining device at the tip and a cylinder for pressing shaft at the other end, said shaft being free to slide vertically through a sleeve cylinder, including means for biasing said sliding shaft through a compression spring, said loader assembly body being connected to the shaft for connecting a loader and fitted between the above mentioned lens position determining device of the holder base body, and further providing a lens grinding swinging device opposed to the shaft so as to make the shaft and the loader movable rightward and leftward to continuously automatically manipulate said lenses.

* * * * *